US007296799B1

(12) United States Patent
Baker

(10) Patent No.: US 7,296,799 B1
(45) Date of Patent: Nov. 20, 2007

(54) POKER GAME

(76) Inventor: Michael D. A. Baker, 3207 Blueford Rd., Kensington, MD (US) 20895

( * ) Notice: Subject to any disclaimer, the term of this patent is extended or adjusted under 35 U.S.C. 154(b) by 120 days.

(21) Appl. No.: 11/265,754

(22) Filed: Nov. 3, 2005

(51) Int. Cl.
*A63F 1/00* (2006.01)

(52) U.S. Cl. ..... 273/292; 273/274; 463/13

(58) Field of Classification Search ..... 273/292, 273/274, 309; 463/13, 12
See application file for complete search history.

(56) References Cited

U.S. PATENT DOCUMENTS

| | | | |
|---|---|---|---|
| 5,382,025 | A | 1/1995 | Sklansky et al. |
| 5,531,448 | A | 7/1996 | Moody |
| 5,752,702 | A | 5/1998 | Mcdoniel |
| 5,823,875 | A | 10/1998 | Tarantino |
| 6,007,066 | A | 12/1999 | Moody |
| 6,206,373 | B1 | 3/2001 | Garrod |
| 6,332,614 | B1 | 12/2001 | Hesse |
| 6,467,771 | B1 | 10/2002 | Dekeller |
| 6,561,897 | B1 | 5/2003 | Bourbour et al. |
| 6,651,983 | B1 | 11/2003 | Chobanian |
| 6,896,265 | B1 | 5/2005 | Schlumbrecht |
| 2004/0262844 | A1 | 12/2004 | Manzo et al. |
| 2005/0001378 | A1 | 1/2005 | Lo |
| 2005/0107148 | A1 | 5/2005 | Webb |

FOREIGN PATENT DOCUMENTS

| | | |
|---|---|---|
| WO | WO 9964128 | 12/1999 |

OTHER PUBLICATIONS

Ultimatebet.com, "Rules & Strategy, Etiquette", www.ultimatebet.com/rules-strategy/etiquette.html, Apr. 16, 2004.*
Ultimatebet.com, "Rules & Strategy, Texas Hold'em Poker Rules, No Limit Poker Rules", www.ultimatebet.com/rules-strategy/texas-holdem.html, Apr. 4, 2004.*
Everest Poker, "Game Controls", www.everestpoker.com/support/controls.html, Dec. 28, 2005.*

* cited by examiner

*Primary Examiner*—Benjamin Layno
(74) *Attorney, Agent, or Firm*—Donald A. Kettlestrings

(57) ABSTRACT

A variation of the poker card game known as Texas Hold'em provides for players folding their cards during a hand to fold the cards face-up. This provides the remaining players in the hand with more information and enables those players to make better decisions as they continue to play the hand.

5 Claims, No Drawings

POKER GAME

BACKGROUND OF THE INVENTION

This invention relates to a poker card game played with fifty-two conventional playing cards, and more particularly to a variation of the known poker card game called Texas Hold'em wherein the players are required to fold their cards face-up.

The poker card game known as Texas Hold'em is well known and currently very popular. The game is played with a standard deck of fifty-two conventional playing cards with no jokers. The game is also played without antes. The game is played so that each player has the use of seven cards in order to form a five card poker hand. The player having the highest poker hand is the winner of the hand. Hands are ranked in standard poker fashion, i.e. royal flush, straight flush, four of a kind, full house, flush, straight, three of a kind, two pairs, one pair and high card, in descending order.

A dealer is typically designated by use of a dealer button, which is a round disk with the word "dealer" on it. It is passed clockwise from hand to hand as the game progresses. The person having the dealer button in front of him is called "on the button". The person to the left of the button is called "in the small blind" and the next person on the left is called "in the big blind". The persons in the "small blind" and in the "big blind" are required to bet and to put money into the pot before the start of the hand. The "small blind" is one-half of the amount of the "big blind".

Once the "blinds" are put into the pot, each player is dealt two face-down cards. These two cards are called the players' hole cards.

The person to the left of the "big blind" is the first person to act. That person looks at his two face-down cards, and then that person has three options. That person determines if he wants to fold (get out of the hand), bet the predetermined minimum amount (the amount of the "big blind"), or to raise. Each person at the table participating in the hand being played has the same three options. This is called the first round of betting.

Once the first round of betting is finished, the so-called "flop" occurs. This is where the dealer deals three community cards face-up on the table. The term "community card" refers to a card that is exposed (face-up) and is available for use by any of the players to form a poker hand.

Another, or second, round of betting then occurs. Each person then decides to fold, check, bet or raise. A player who checks is indicating that he wishes to remain in the hand being played but does not want to place a bet. But, if another player later in the round of betting places a bet, the player checking must call by betting the amount bet by the other player to remain in the hand being played. Once this second round of betting is finished, a fourth community card is dealt face-up on the table for all remaining players still in the hand to use to form a poker hand. The fourth card is sometimes called "the turn" or "fourth street". Another, or third, round of betting then occurs wherein each player decides to fold, check, bet or raise.

Then the fifth and last community card is dealt face-up on the table. The fifth card is called "fifth street" or "the river". Another, or fourth, round of betting then occurs wherein each player decides to fold, check, bet or raise.

Each player remaining in the hand has a total of seven cards (the five community cards face-up on the table and the two face-down cards that each player was initially dealt). The best five cards out of seven are used to make the best poker hand according to the conventional predetermined poker ranking system. The best poker hand wins the pot and all of the money in the pot.

The dealer then shuffles the deck before starting the next hand. Texas Hold'em can be played with betting limits for each round of betting or it can be no limit Texas Hold'em. No limit Texas Hold'em means that at any time a player can bet all of his chips or money.

BRIEF SUMMARY OF THE INVENTION

In playing Texas Hold'em, players fold their two hole cards face-down. The present invention provides for a poker game that is identical to the known poker game of Texas Hold'em in every respect except that players are required to fold their hole cards face-up. As a result, the remaining players in the hand can see what cards are no longer in play. The name of the game of the present invention is Texas Hold'em Fold-Up.

DETAILED DESCRIPTION OF THE INVENTION

Folding up has a major impact on the game because the remaining players know more information. The more information a player knows, the better decisions he can make. Suppose, for example, that a first player's two face-down hole cards are an Ace and a King. If as other players fold their hole cards, they fold three Aces and three Kings (for example, one player folds a King and a Six, another folds an Ace and a Four, and so on), this means that if the first player stays in the hand, he knows that the deck does not contain any more Aces or Kings. Unless his cards are of the same suit, say both hearts, and he is trying to make a flush, he probably would decide to get out of the hand, because he knows his hand cannot improve on the "flop", "turn" or "river". However, the exact opposite is true if he sees no one fold an Ace or a King. It is now possible that any of the remaining three Kings and three Aces could show up on the "flop", "turn" or "river". Thus he would most likely stay in the hand. The same is true if he is trying to make a flush or a straight and most of the cards that would help him are not turned up when other players fold.

With the present invention or Texas Hold'em Fold-Up (either Limit or No Limit) many things can occur that cannot occur with the current Texas Hold'em game. As an example: a player (player A) called the minimum bet. A few more players call, someone raises and six players fold, face-up. The person who first entered the pot (player A) with the minimum bet and now has to decide if he is going to bet more (raise) and the amount of the raise, now has a lot more additional information before the "flop".

With the current Texas Hold'em game, no additional cards are shown until after the "flop". In the present invention, an additional twelve cards have been shown. Those twelve cards plus player A's two hole cards represent more than one-fourth of all cards in the deck. Now player A, who first entered the pot, can make a very informed decision, based on all the new information. The situation might have gotten substantially better, or worse, but the point is the player has this additional information that he would not have with the current Texas Hold'em game. Of course, this additional information continues to grow as some of the remaining players fold-up after the "flop".

Other major changes with Texas Hold'em Fold-Up exist when compared to the known Texas Hold'em game. Many players have a table image. Other players know their image, and they use that image to help them to win pots. But with Texas Hold'em Fold-Up everyone gets to see what cards a player is not playing (choosing to fold) before the "flop", and what cards a player entered the pot with and then later folded after the "flop". Thus, how a player is really playing, and not their table image, is what matters with Texas Hold'em Fold-Up. A player may be playing very tightly and only choosing to enter pots with high cards, Aces and Kings, or a player may be playing very loosely and entering pots with just about any two hole cards. The player's manner of playing will be known to the other players when playing Texas Hold'em Fold-Up.

Another change is that many players know the odds of the cards that they need appearing on the "flop", "turn" or "river". As more and more players fold, the odds change with each two hole cards that are folded face-up. Thus, with Texas Hold'em Fold-Up, the odds are constantly changing. Another change is that you get to see what a player raised with, and then later folded. You see why they raised. Were they bluffing, trying for a straight, or a flush, or have a pocket pair? (An example of a pocket pair would be both face-down hole cards being sevens.) With the current Texas Hold'em poker game, when a player folds they fold with their cards face-down. You do not know what cards they had. Thus, Texas Hold'em Fold-Up (Limit or No Limit) is a more exciting game than the current Texas Hold'em poker game.

The game of this invention is played with a fifty-two conventional deck of playing cards, without jokers. The aim of each player is to achieve a winning poker hand, using two concealed, hole cards held by each player and five community cards available to all players.

The method of playing the poker card game of this invention includes the steps of:

designating a dealer for the hand to be played;

a first player to the immediate left of the dealer placing a first bet;

a second player to the immediate left of said first player placing a second bet;

the dealer dealing two hole cards, face-down, to all players;

requiring each of said players, beginning with a third player to the immediate left of said second player and continuing clockwise among all of said players, after viewing only their own face-down cards, to participate in a first round of betting;

said first round of betting requiring each of said players to place a first minimum bet, to raise by betting an amount greater than the highest preceding amount bet by another player during the first round of betting or to get out of the hand by folding their cards face-up;

if at least two players remain in the hand, the dealer dealing three community cards face-up, wherein each community card is usable by any player still in the hand to form a five card poker hand together with the two face-down cards previously dealt to said player;

requiring each of said players remaining in the hand, beginning with the first remaining player to the left of the dealer and continuing clockwise among all of said players remaining in the hand to participate in a second round of betting.

said second round of betting requiring each of said players remaining in the hand to check by indicating the player wishes to remain in the hand being played but does not want to place a bet although if another player later in the second round of betting places a bet the player checking must call by betting the amount bet by said another player to remain in the hand being played, to place a second minimum bet, to raise by betting an amount greater than the highest preceding amount bet by another player during the second round of betting, or to get out of the rest of the hand by folding their cards face-up;

if at least two players remain in the hand, the dealer dealing a fourth community card face-up;

requiring each of said players remaining in the hand, beginning with the first remaining player to the left of the dealer and continuing clockwise among all of said players remaining in the hand to participate in a third round of betting;

said third round of betting requiring each of said players remaining in the hand to check by indicating the player wishes to remain in the hand being played but does not want to place a bet although if another player later in the third round of betting places a bet the player checking must call by betting the amount bet by said another player to remain in the hand being played, to place a third minimum bet, to raise by betting an amount greater than the highest preceding amount bet by another player during the third round of betting, or to get out of the rest of the hand by folding their cards face-up;

if at least two players remain in the hand, the dealer dealing a fifth community card face-up;

requiring each of said players remaining in the hand, beginning with the first remaining player to the left of the dealer and continuing clockwise among all of said players remaining in the hand to participate in a fourth round of betting;

said fourth round of betting requiring each of said players remaining in the hand to check by indicating the player wishes to remain in the hand being played but does not want to place a bet although if another player later in the fourth round of betting places a bet the player checking must call by betting the amount bet by said another player to remain in the hand being played, to place a fourth minimum bet, to raise by betting an amount greater than the highest preceding amount bet by another player during the fourth round of betting, or to get out of the rest of the hand by folding their cards face-up;

all players remaining in the hand after the fourth round of betting has been completed revealing their two individual cards that were previously dealt to them face-down; and determining the winner of the hand by comparing hands of all players remaining in the hand based on each player's hole cards and the five community cards, according to a predetermined poker ranking system.

The first player to the immediate left of the dealer is called "in the small blind" and the second player to the immediate left of the first player is called "in the big blind". These are two forced bets that are put into the pot before the start of the hand. The "small blind" is one-half the amount of the "big blind". The amount of the bet by the person in the big blind must be equal to a predetermined minimum bet established for the hand being played.

As in the conventional Texas Hold'em poker card game, the poker card game of this invention can be played wherein a predetermined limit is placed on the amount of each bet made during the hand being played or wherein no limit is placed on the amount of each bet during the hand being played.

The invention in its broader aspects is not limited to the specific details shown and described, and departures may be made from such details without departing from the principles of the invention and without sacrificing its chief advantages.

What is claimed is:

1. A method of playing a poker card game with fifty-two conventional playing cards, comprising the steps of:

designating a dealer for the hand to be played;

a first player to the immediate left of the dealer placing a first bet;

a second player to the immediate left of said first player placing a second bet;

the dealer dealing two hole cards, face-down, to all players;

requiring each of said players, beginning with a third player to the immediate left of said second player and continuing clockwise among all of said players, after viewing only their own face-down cards, to participate in a first round of betting;

said first round of betting requiring each of said players to select from one of a plurality of decisions including placing a first minimum bet, raising by betting an amount greater than the highest preceding amount bet by another player during the first round of betting or getting out of the hand by folding and requiring players that folded to reveal their cards face-up for viewing by all of the players;

if at least two players remain in the hand, the dealer dealing three community cards face-up, wherein each community card is usable by any player still in the hand to form a five card poker hand together with the two face-down cards previously dealt to said player;

requiring each of said players remaining in the hand, beginning with the first remaining player to the left of the dealer and continuing clockwise among all of said players remaining in the hand to participate in a second round of betting;

said second round of betting requiring each of said players remaining in the hand to select from one of a plurality of decisions including checking by indicating the player wishes to remain in the hand being played but does not want to place a bet although if another player later in the second round of betting places a bet the player checking must call by betting the amount bet by said another player to remain in the hand being played, placing a second minimum bet, raising by betting an amount greater than the highest preceding amount bet by another player during the second round of betting, or getting out of the rest of the hand by folding and requiring players that folded to reveal their cards face-up for viewing by all of the players;

if at least two players remain in the hand, the dealer dealing a fourth community card face-up;

requiring each of said players remaining in the hand, beginning with the first remaining player to the left of the dealer and continuing clockwise among all of said players remaining in the hand to participate in a third round of betting;

said third round of betting requiring each of said players remaining in the hand to select from one of a plurality of decisions including checking by indicating the player wishes to remain in the hand being played but does not want to place a bet although if another player later in the third round of betting places a bet the player checking must call by betting the amount bet by said another player to remain in the hand being played, placing a third minimum bet, raising by betting an amount greater than the highest preceding amount bet by another player during the third round of betting, or getting out of the rest of the hand by folding and requiring players that folded to reveal their cards face-up for viewing by all of the players;

if at least two players remain in the hand, the dealer dealing a fifth community card face-up;

requiring each of said players remaining in the hand, beginning with the first remaining player to the left of the dealer and continuing clockwise among all of said players remaining in the hand to participate in a fourth round of betting;

said fourth round of betting requiring each of said players remaining in the hand to select from one of a plurality of decisions including checking by indicating the player wishes to remain in the hand being played but does not want to place a bet although if another player later in the fourth round of betting places a bet the player checking must call by betting the amount bet by said another player to remain in the hand being played, placing a fourth minimum bet, raising by betting an amount greater than the highest preceding amount bet by another player during the fourth round of betting, or getting out of the rest of the hand by folding and requiring players that folded to reveal their cards face-up for viewing by all of the players;

all players remaining in the hand after the fourth round of betting has been completed revealing their two individual cards that were previously dealt to them face-down; and determining the winner of the hand by comparing hands of all players remaining in the hand based on each player's hole cards and the five community cards, according to a predetermined poker ranking system.

2. The method of claim 1 wherein said first bet is required to be one-half the amount of said second bet.

3. The method of claim 2 wherein said second bet is equal to a predetermined minimum bet established for the hand being played.

4. The method of claim 1 wherein a predetermined limit is placed on the amount of each bet made during the hand being played.

5. The method of claim 1 wherein no limit is placed on the amount of each bet made during the hand being played.

* * * * *